US006209741B1

(12) United States Patent
Boucher-Giles

(10) Patent No.: US 6,209,741 B1
(45) Date of Patent: Apr. 3, 2001

(54) COLLAPSIBLE CONTAINER

(75) Inventor: Richard Boucher-Giles, Burton-on-Trent (GB)

(73) Assignee: Woodall Plastic Products Limited, Staffordshire (GB)

( * ) Notice: Subject to any disclaimer, the term of this patent is extended or adjusted under 35 U.S.C. 154(b) by 0 days.

(21) Appl. No.: 09/068,190

(22) PCT Filed: Oct. 31, 1996

(86) PCT No.: PCT/GB96/02663

§ 371 Date: Nov. 9, 1998

§ 102(e) Date: Nov. 9, 1998

(87) PCT Pub. No.: WO97/16353

PCT Pub. Date: May 9, 1997

(30) Foreign Application Priority Data

Oct. 31, 1995 (GB) ..... 9522232

(51) Int. Cl.[7] ..... B65D 7/00
(52) U.S. Cl. ..... 220/6; 220/4.28; 220/7
(58) Field of Search ..... 220/6, 837, 842, 220/847, 7, 4.28

(56) References Cited

U.S. PATENT DOCUMENTS

| | | | | |
|---|---|---|---|---|
| 4,044,910 | * | 8/1977 | Box | 220/6 X |
| 4,967,927 | | 11/1990 | Beiland, et al. | 220/337 |
| 5,394,981 | | 3/1995 | Cameron | 206/232 |
| 5,515,987 | * | 5/1996 | Jacques et al. | 220/7 X |
| 5,538,153 | * | 7/1996 | Markovskis et al. | 220/6 |
| 5,588,549 | * | 12/1996 | Furtner | 220/6 X |

FOREIGN PATENT DOCUMENTS

| | | |
|---|---|---|
| 0073357 | 3/1983 | (EP) . |
| 0655392 | 5/1995 | (EP) . |
| 0233946 | 5/1925 | (GB) . |
| 1398116 | 6/1975 | (GB) . |
| 2277076 | 8/1996 | (GB) . |
| 2303616 | 2/1997 | (GB) . |

* cited by examiner

*Primary Examiner*—Steven Pollard
(74) *Attorney, Agent, or Firm*—Mark R. Wisner

(57) ABSTRACT

A collapsible container having a base and four side walls upstanding from the base, the side walls being hinged to the base so that they may occupy positions in which the side walls upstand from the base or in which they overlie the base by folding the side walls inwardly relative to the base. The side walls are molded separately from the base, and there are provided engaging means on sides of the base and lower parts of the side walls to enable the side walls to be secured to the base. Engagement of the side walls with the base is such that whilst the side walls may be relatively easily attached to the base, removal of the side walls from the base is hindered, for example by virtue of a snap fitting engagement.

20 Claims, 5 Drawing Sheets

Figure 3:
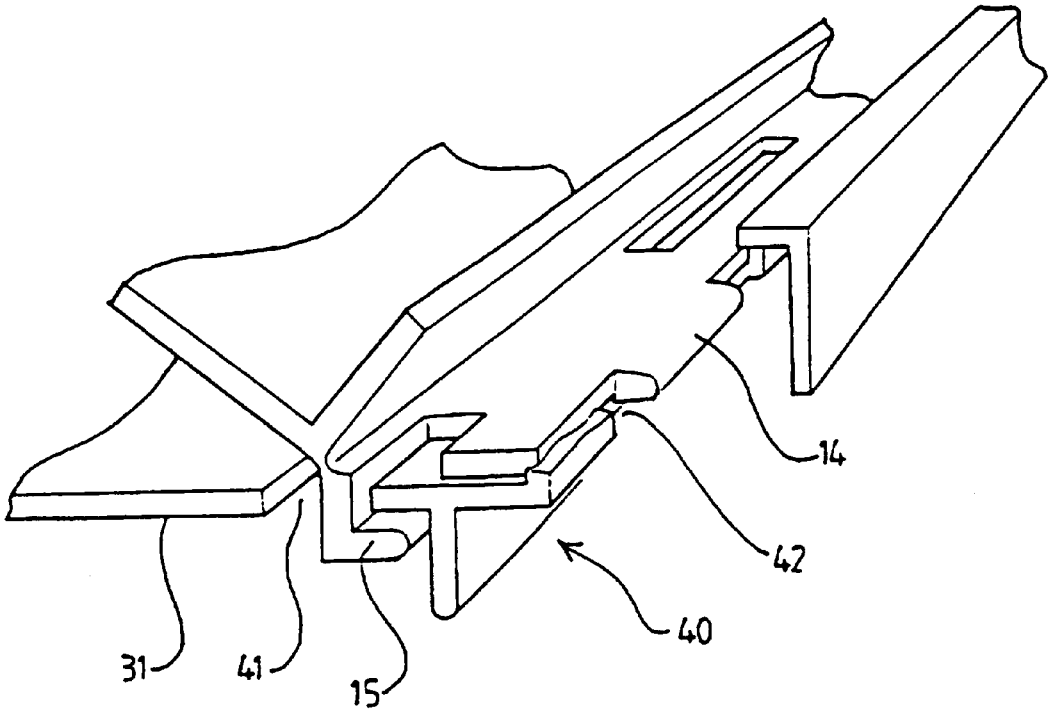

FIG 1
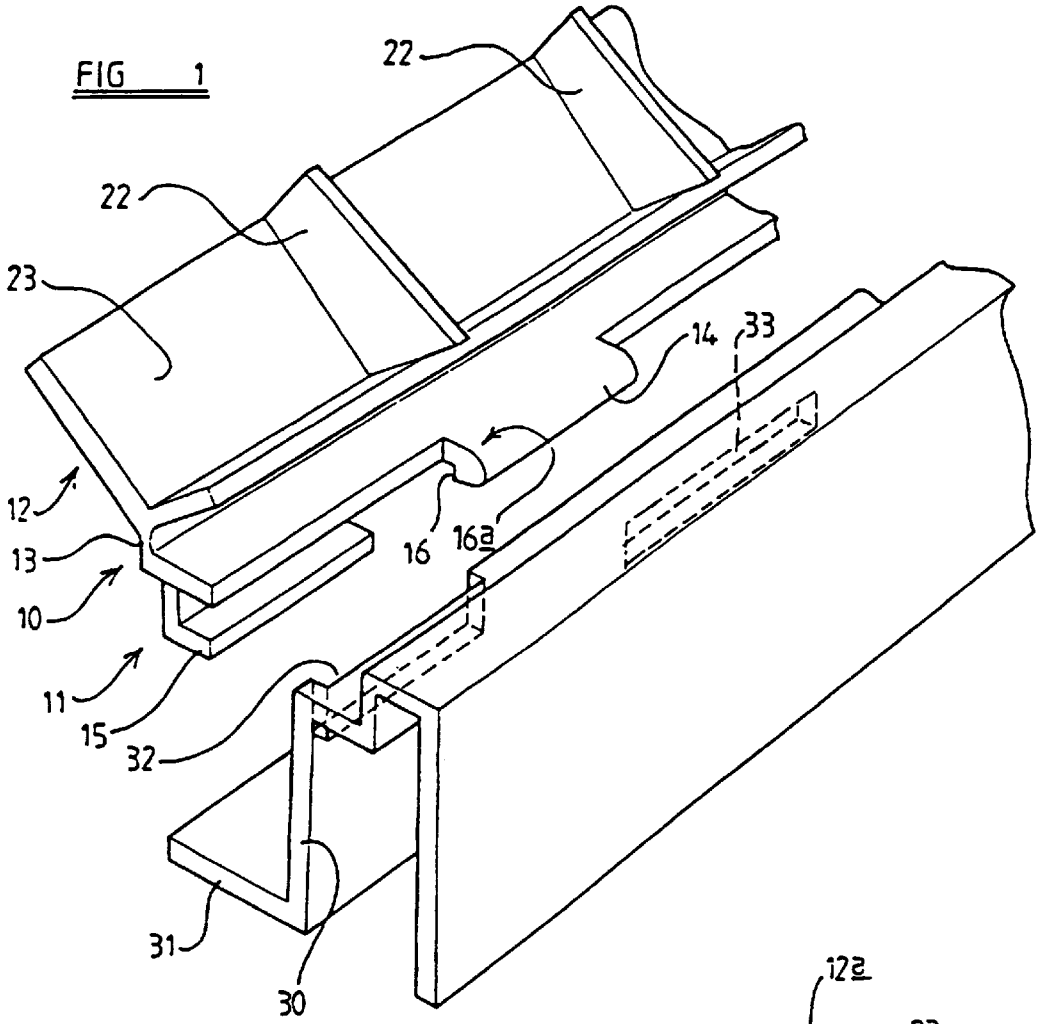
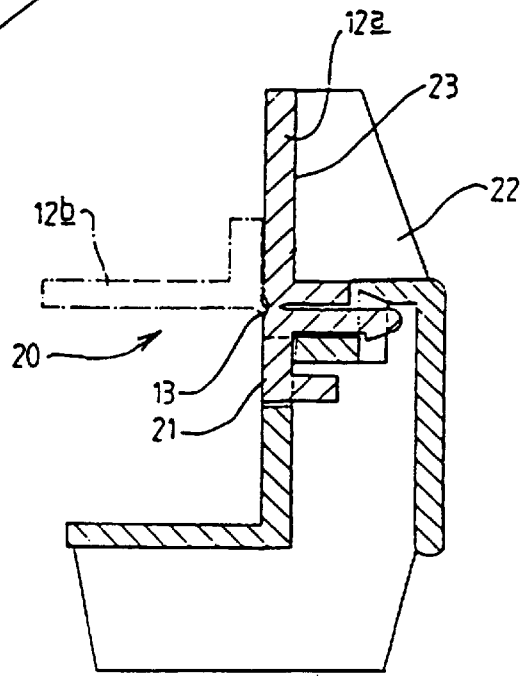
FIG 2

FIG 8
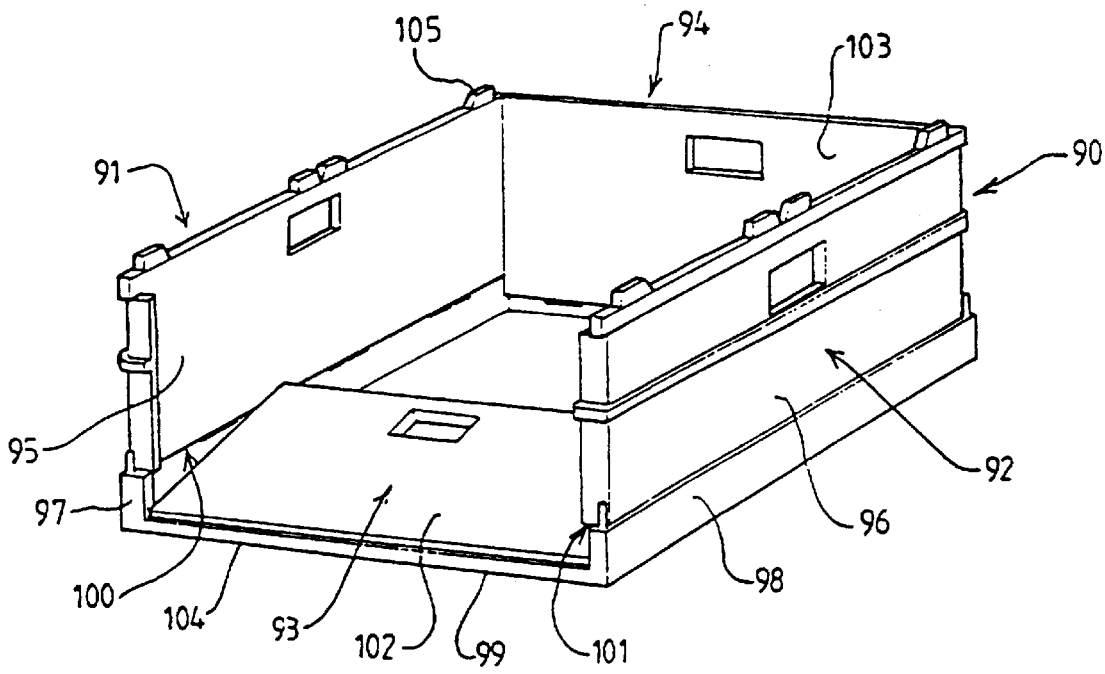
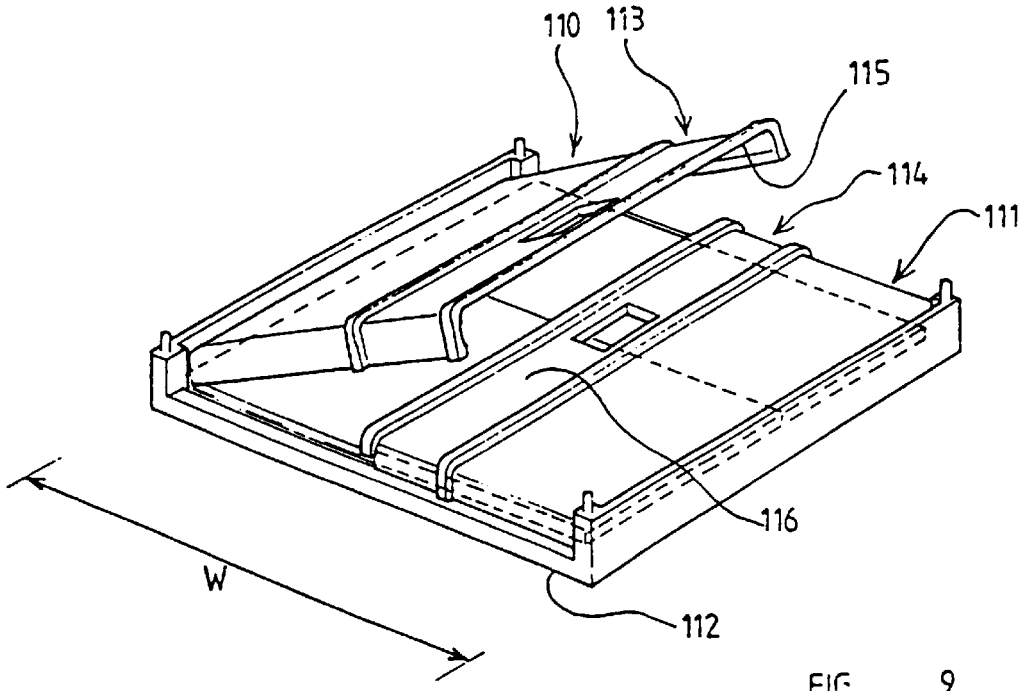
FIG 9

COLLAPSIBLE CONTAINER

DESCRIPTION OF INVENTION

This invention relates to a container of the type having a base and four side walls (normally four) upstanding from sides of the base, wherein the side walls are hinged for movement relative to the base and which side walls may accordingly occupy positions in which they upstand from the base or in which they overlie the base by inwardly folding the side walls relative to the base.

A variety of such containers are known, and a particularly suitable construction of such has previously been found to be of the type whereby the entire container, i.e., the base and the side walls, are formed from a unitary plastics moulding. In such a construction, conveniently a "live" hinge is utilised in which adjacent parts of the container, whilst being formed in one piece, are separated by a "score" or line of reduced thickness, about which the adjacent parts may be relatively pivoted. On the one hand, such a construction enables relatively fast manufacture and assembly of a container, but on the other hand the moulds required for such construction are by necessity complex and accordingly expensive to manufacture and maintain. Additionally if part of the container should be irreparably damaged it may be necessary to replace the entire container.

It is accordingly an object of the present invention to provide an improved container which overcomes or reduces the problems outlined above.

According to a first aspect of the invention, there is provided a container having a base and side walls extending from sides of the base, wherein at least some of the side walls are movable relative to the base to enable the container to be folded, and wherein at least some of the side walls are moulded separately from the base.

Preferably, all the side walls are movable relative to the base, and conveniently all the side walls are each moulded in one piece separately from the base.

The side walls moulded separately from the base are preferably engageable with the base so as to form a substantially rigid connection between part of the side walls and the base.

The side walls are preferably movable relative to the base by virtue of hinges, which may be provided on or which may be integral with the base. Preferably however the hinges are provided on or are integral with the side walls.

Thus conveniently, the base has first engaging means along some at least of the sides of the base, and some at least of the associated side walls have a fixing portion provided with second engaging means, the first and second engaging means being capable of engagement to secure the side walls to the base, there being provided a side wall portion hinged to each fixing portion.

Conveniently the first and second engaging means enable the fixing portions and base to be substantially rigidly secured together.

Advantageously first engaging means are provided on all sides of the base, and all side walls are provided with a fixing portion as aforesaid.

The side walls may be secured to the base in a substantially permanent manner, as for example by welding, conveniently by ultrasonic welding.

Preferably, however, the second engaging means of the side walls are engageable with receiving apertures of the base, and conveniently such engagement may include a snap fitting engagement. In such a case, the first engaging means may comprise recesses or apertures provided in the sides of the base, and the second engaging means may comprise engaging formations such as tongues or like protrusions adapted to be insertable into the recesses or apertures by causing resilient deformation of material surrounding the recess or aperture, and/or by the engaging formations undergoing resilient deformation themselves. Preferably, the tongues or like protrusions may generally only pass through the recess or aperture in one direction, such that they become retained in position once such insertion is complete and are thus prevented from removal.

The tongues or like protrusions adapted for such snap fitting engagement may comprise a rearwardly facing surface (when taken in the direction of insertion), providing an abutment surface, which when the tongue is inserted into the recess or aperture abuts part of the material surrounding the recess or aperture, thus hindering or preventing removal of the tongue or like protrusions, by movement in an opposite direction.

Thus, the tongue or like protrusions may be of generally barbed bayonet type configuration, and there may be provided such an abutment surface on one or each side of the tongue.

It is envisaged that not all of the tongues or like protrusions may be adapted for such snap fitting engagement, and it may be desirable for some of the tongues or like protrusions to merely be locatable within a corresponding recess or aperture and not necessarily be lockable therein. The corresponding recess or aperture may be provided at a lower position relative to the side of the base than the recesses or apertures adapted for snap fitting engagement.

Those tongues or like protrusions which are not provided with such a bayonet type configuration may comprise a tapered end part to facilitate location within the corresponding recess or aperture.

The container may be square in plan view. Preferably however, the base of the container is rectangular in plan view. In such a case, the fixing portions of a first pair of opposite side walls are preferably mounted at a higher level relative to the base than those of a second pair of opposite side walls. Accordingly, the second pair of opposite side walls shall henceforth be referred to as the "end walls". Accordingly, the second pair of opposite side walls shall henceforth be referred to as the "end walls".

Conveniently, the side walls of the first pair are longer than those of the second pair, and for the sake of convenience herein shall be henceforth referred to as the "longer" side walls.

Each side wall portion is preferably hinged to a respective fixing portion by a film of plastics material, such a hinge being commonly known as a "live" hinge. Preferably the side walls are formed from the same material as the hinge, and conveniently, the entire container may be formed from such a material. A particularly suitable material has been found to be the plastics material polypropylene, although it is envisaged that any other suitable material may be employed without detracting from the scope of the invention. Thus, the side walls are preferably formed as a single moulding, the side wall portion, the "live" hinge and the fixing portion thus preferably being integral with each other.

The longer side wall portions may have upper parts configured to permit one longer side wall portion to partially overlie the other when in an inwardly folded position, whilst still presenting a generally planar outwardly facing surface. To this end, the upper parts may be asymmetrical with respect to each other, and conveniently the asymmetric parts may comprise parts of reduced thickness.

It is anticipated that the parts of reduced thickness on the upper parts of the longer side wall portions may be tapered parts, the parts tapering generally towards the base of the container when the side walls are in a generally upstanding condition.

Accordingly, when it is desired for the side walls to be folded inwardly towards the base, so as to provide a collapsed condition of the container, the longer side walls are preferably folded after the end walls such that the longer side walls each partially overlie the end walls and partially overlie each other.

Preferably, ends of the longer side walls are provided with attachment formations such as clips or hooks adapted for engagement with corresponding parts on the end walls. Preferably, the longer side walls are provided at their ends with inturned formations, said formations being inturned towards the interior of the container, said attachment formations being provided on said inturned formations. Conveniently, the inturned formations lie generally in the same plane as the adjacent end wall when the side walls are in a generally upstanding condition, so that in an erected condition, the end wall may be brought into abutment with the inturned formations enabling the attachment formations to engage with corresponding parts on the end wall. Preferably, the or each attachment formation comprises a clip and the corresponding part on the adjacent end wall comprises an aperture or recess. Conveniently, the clip is adapted to resiliently deform during insertion into the apertures or recesses. Additionally, part of the end wall adjacent or surrounding the recess or aperture may also resiliently deform during insertion of the clip. The clip may be configured such that insertion of the clip into the recess or aperture is easier than removal of the clip. Such an arrangement provides that engagement of the clip and aperture may readily be achieved, whereas releasing the clip from the aperture is hindered.

Preferably, the engagement between the attachment formations and the apertures is such that by relative generally vertical displacement of the longer side wall and adjacent end wall, the engagement may be released. Preferably, such relative displacement comprises relative upward movement of the longer side wall, and relative downward movement of the adjacent end wall. Such relative vertical displacement is preferably achieved by flexing or compression of the base, longer side walls and end walls. In particular, it is envisaged that there may be provided a section of reduced strength, for example a cut away section on the base, generally below a corner defined by a longer side wall and an adjacent end wall. Preferably, such a portion of reduced strength permits parts of the base adjacent the portion to be displaced generally vertically relative to each other, and since the side walls are engaged with recesses or apertures at that part of the base, relative vertical displacement of the side walls is permitted. Additionally, it is envisaged that the "live" hinge by which the side wall portions are hinged to the fixing portions may not extend to the corners of the base. In particular, the hinge may terminate approximately 30 mm from each corner. This further enables relative vertical movement of the side walls to be achieved.

Each side wall of the container may be provided with one or more ventilation holes, and it is anticipated that each side wall may have a "fluted" configuration in order to provide resistance to distortion caused by compression forces acting from above the side walls. To reduce the effect of any bending which may occur to the side walls, reinforcing cross members may be provided generally horizontally, through or along each side wall.

According to a second aspect of the invention, there is provided a container having a base and side walls extending from sides of the base, wherein at least some of the side walls are movable relative to the base to enable the container to be folded, and wherein at least one pair of opposite side walls partially overlie each other when the container is in a folded condition, and wherein the pair of opposite side walls have mutually interfitting formations to enable the side walls to substantially interfit when in a folded condition.

Figure 5:
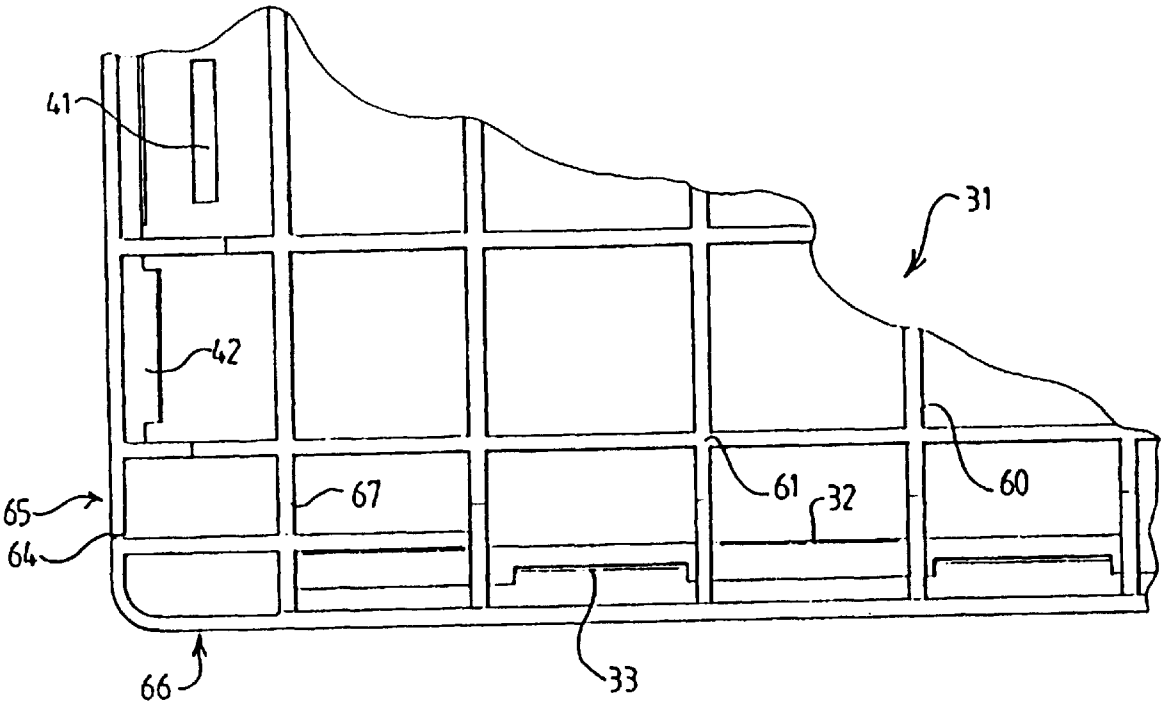
Figure 4:
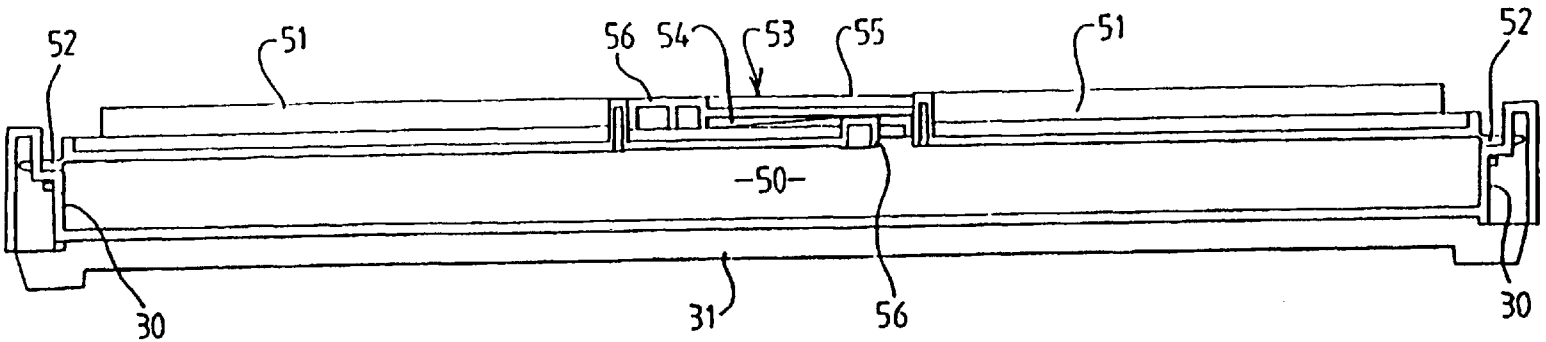
Figure 6:
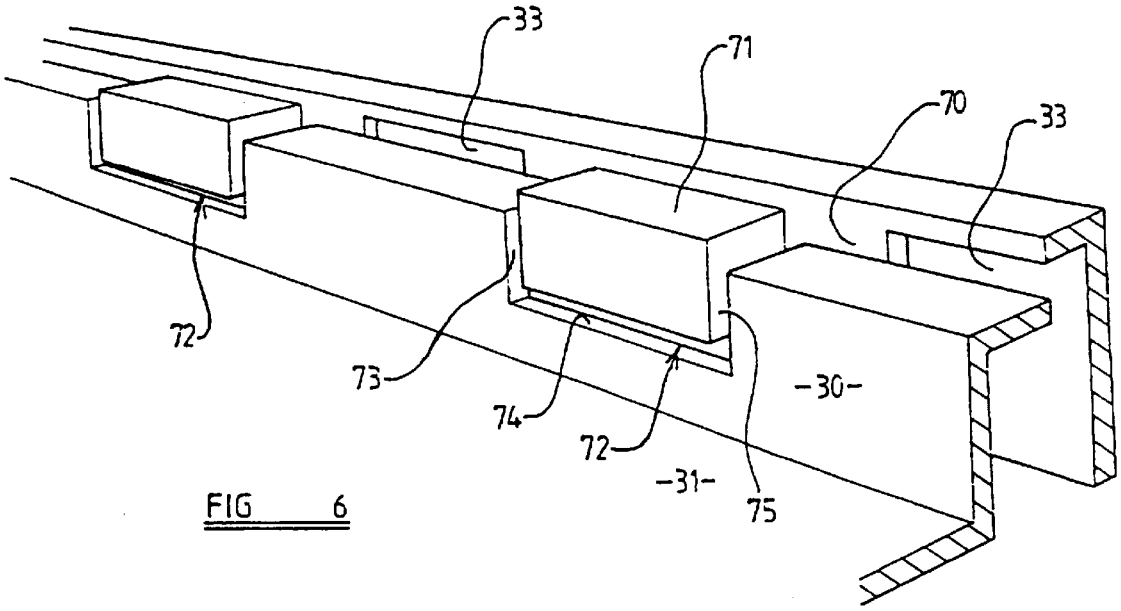
Figure 7:
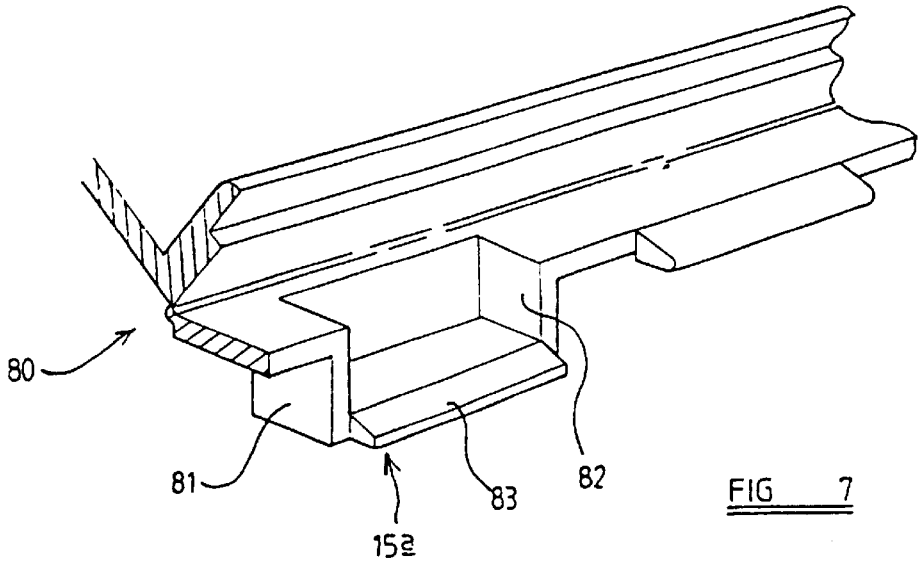

The invention will now be described in greater detail and by way of example only by reference to the accompanying drawings wherein:

FIG. 1 is a schematic view illustrating the engagement of a side wall with a side of the base of the container, FIG. 2 is a side schematic view showing the side wall portion in upright and inwardly folded positions relative to the fixing portion and base, FIG. 3 is a similar view to that shown in FIG. 1 but in respect of an end of the container, FIG. 4 is a cross section of a container with end walls and longer side walls in an inwardly folded position, and FIG. 5 is an underside plan view of a base of a container showing a cut away section permitting of flexing of a corner of the container, FIG. 6 is a view of an alternative embodiment of part of the base and adjacent side thereof, FIG. 7 shows an alternative embodiment of a side wall, FIG. 8 shows an assembled container with one end wall in a partially inwardly folded condition, and FIG. 9 shows a different sized container in an almost fully folded condition.

Referring first to FIG. 1, there is shown a side wall 10 of a container having a fixing portion 11 and a side wall portion 12 hinged to the fixing portion 11 by a "live" hinge 13 which in this example is in the form of a polypropylene plastics film hinge. The fixing portion 11 comprises clip hooks 14 (one of which is shown) and under hooks 15 adapted for engagement with receiving apertures 33 and 32 of an associated base 31. It is envisaged that the receiving apertures be generally elongate, wherein the plastics material surrounding at least those apertures 33 adapted for insertion of the clip hooks 14 is resiliently deformable so as to permit insertion of the clip hook, but by virtue of shoulder 16, on the clip hook, hinder release of the clip hook from the aperture. Alternatively, the material from which the clip hook is formed may be resiliently deformable to enable such engagement.

Whilst in the drawings, the clip hook 14 is shown with one shoulder 16, it is envisaged by the applicants that a corresponding shoulder may be provided on the other side of the clip, in the region indicated generally at **16*a* so as to provide a barbed "bayonet" type construction, offering increased resistance against removal of the clip hook 14 from the aperture 33**.

There is shown a side part 30 of a base 31 of a container, the side part 30 being angled generally upwardly relative to the base so as to raise the position of side wall 10 relative to the base. The side part 30 has the apertures 32 and 33 along its length. It can be seen that in the case of clip hook 14, there is provided clearance either side of the clip hook, although in the case of underhook 15, the associated aperture 32 is substantially the same length as the underhook such that lateral movement of the side wall relative to the side part 30 is restricted. Of course, by virtue of the shoulders 16 provided on clip hooks 14, movement in a direction perpendicular to this, i.e. inwardly of the container, is prevented. Accordingly, once the side wall 10 has been "snap fitted" into the side part 30 of base 31 the side wall remains securely attached and only the side wall portion 12 is movable, by virtue of the live hinge 13.

Referring next to FIG. 2, the side wall 10 shown in FIG. 1 is illustrated in schematic side view. The live hinge 13 is located towards a rear part 20 of the fixing portion 11 such that when the side wall portion is in an upright position as shown in solid outline at 12*a*, the side wall portion lies generally flush with rear faces 21 of the clip hook 14 and underhook 15. Braces 22 are provided to give increased strength and resistance to outward bending of the side wall. It is envisaged that the braces may be in the form of fins and one or more may be disposed along the outward face 23 of the side wall portion. The side wall portion when in an inwardly folded position is shown in dotted outline at 12*b* (braces 22 not shown).

Referring now to FIG. 3, a similar arrangement to that shown in FIG. 1 is illustrated, although FIG. 3 illustrates a construction at an end part of a container, rather than of a longer side wall part as shown in FIG. 1.

An end support part 40 of base 31 is shown which is analogous to side part 30 as shown in FIG. 1, although end support part 40 is mounted lower relative to the base than is side part 30. Accordingly, underhook 15 is introduced into an aperture 41 in the base 31, where the aperture 41 corresponds to aperture 32 of FIG. 1, although aperture 41 is generally coplanar with the base, whereas aperture 32 is generally perpendicular to the base. Similarly, there is provided an aperture 42 for insertion of clip hook 14 and again, aperture 42 is located relatively lower than corresponding aperture 33 as shown in FIG. 1.

Referring now to FIG. 4, there is shown a cross-sectional side view of a container having end walls and longer side walls in an inwardly folded position. For the sake of clarity, the folded end walls are not shown, although it should be appreciated that the folded end walls lie below the folded longer side walls in the space generally indicated at 50. The base 31 is not illustrated in great detail, since the construction of the majority thereof does not form part of the present invention.

Longer side walls 51 are shown in an inwardly folded position, the side walls 51 having fixing portions 52 as illustrated by reference number 11 in FIGS. 1 and 2. Side part 30 of the base 31 is clearly shown, and it can be seen that by virtue of side part 30, the longer side walls 51 are hinged relatively higher than the end walls which when folded occupy the space 50. Upper parts 53 of the longer side walls 51 are tapered as indicated at 54 such that when in an inwardly folded position, the upper parts of the side walls 51 may overlie each other whilst presenting a generally planar outer surface 55. The side walls 51 comprise braces 22 as illustrated in FIGS. 1 and 2 and are also provided with generally horizontally extending support ribs 56 which provide further strength to the side walls.

Referring now to FIG. 5, this shows a corner of the underside of the base 31, the base comprising cross braces 60 meeting generally at right angles at nodes 61. Apertures 32, 33, 41 and 42 are shown which receive catch hooks 14 and under hooks 15 (not shown) of fixing portions 11.

It is envisaged that side walls 51 and end walls be engageable with each other by use of a catch arrangement (not shown). The catch arrangement is such that release of the catch may only be achieved by relative generally vertical displacement of the side walls 51 and end walls, and such vertical displacement may be achieved by virtue of the inherent flexibility of a plastics material from which the container is formed, and in particular the flexibility of live hinge 13. However, it is anticipated that further flexibility may be required in order for such a catch arrangement to be disengaged, and accordingly a cut away 64 is provided towards the corner of the base which enables relative vertical movement of adjacent parts 65 and 66 of the base 31. The flexibility given by this cut away section is sufficient to allow engagement and disengagement of the catch part on the side and end walls, but is not so great so as to enable the catch parts to become detached accidentally, for example when the container is subjected to a heavy load. If necessary, the bracing section indicated at 67 may be removed in order to provide additionally flexibility at the corner position.

Referring now to FIG. 6, part of the base 31 is shown, as is an inside view of side part 30 of the base, comprising apertures 33 to receive clip hooks (not shown) on a corresponding side wall, as shown generally in FIG. 1. There are provided integrally with intermediate side part 70, in which the apertures 33 are provided, box like formations 71 located generally within spaces 72 in the side part 30. The box like formations are of a dimension such that gaps 73 to 75 are provided between the box like formations and adjacent parts of the side part 30, in which may be received corresponding formations provided on the side wall, as shown in FIG. 7.

Referring now to FIG. 7, there is shown a side wall 80 corresponding generally to the side wall 10 shown in FIG. 1, but wherein the under hook 15 of FIG. 1 is modified and shown at 15*a*, by the provision of side supports 81 and 82 and tapered foot 83, wherein the side supports and tapered foot are configured to locate within gaps 73, 75 and 74 respectively in the base side shown in FIG. 6.

Since the side wall 80, when attached to the base side shown in FIG. 6, makes greater contact with the base side, by virtue of the box like formation, than is the case when the side wall and base are configured as shown in FIG. 1, the side wall and base construction is considerably strengthened.

Referring now to FIG. 8, an assembled container 90 is shown having longer side walls 91, 92 and end walls 93 and 94 wherein in the figure end wall 93 is partially inwardly folded. The side walls 91 and 92 comprise side wall portions 95 and 96 attached to side parts 97 and 98 of the base 99 by fixing portions (not shown) as generally indicated in FIGS. 1 to 4.

The side wall portions 95 and 96 are hinged to the respective fixing portions by "live" hinges provided in the regions generally indicated at 100 and 101.

The end walls 93 and 94 comprise end wall portions 102 and 103 attached to lower sides of the base, one of which is shown at 104, in the manner generally indicated in FIG. 3.

Since the end walls are mounted relatively lower to the base than the longer side walls, they may be inwardly folded below the longer side walls to produce a generally flat folded container, as described later in relation to FIG. 9.

The container also comprises guide posts near upper corners of the container, one of which is shown at 105 which enable the container to locate with another container above it when stacking of containers is required.

Referring now to FIG. 9, a similar container to that shown in FIG. 8 is shown, but of slightly different dimension. Specifically, the side walls 110 and 111 are of a height, when in an upstanding position, which is greater than half of the width W of the base 112 of the container.

Thus, when the side walls 110 and 111 are folded inwardly, upper parts 113 and 114 overlap each other, and the upper parts are configured to allow the upper parts to generally interfit with each other when the side walls 110 and 111 are in an inwardly folded position. In FIG. 9, the configuration is such that the upper part 113 of side wall 110 has a generally concave inner surface 115 whereas the upper part 114 on side wall 111 has a generally convex outwardly facing surface 116.

The invention provides advantages over collapsible containers previously known since whilst the benefits of a one-piece container are obtained, the base and side walls are moulded separately from each other, such that moulding tools are considerably simplified, and production costs accordingly reduced. By virtue of the provision of a separately formed base, side walls of differing dimensions may be added as needs require.

Furthermore, should the container become damaged it is possible to replace only that part which is damaged, such as a side wall for example, rather than replacing the complete container.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

What is claimed is:

1. A container comprising a base and side walls for mounting on the base, the base comprising engaging means adjacent to each side edge thereof and each side wall comprising a fixing portion and a folding portion hingedly connected to the fixing portion, wherein each fixing portion is engageable with one of the engaging means by locating the side wall adjacent to one of the side edges of the base and moving the fixing portion outwardly of the base in a direction extending at right angles to said side edge and the fixing portion into snap-fitting engagement with the mounting means to provide a substantially rigid connection between the fixing portion and the base.

2. A container according to claim 1 wherein the engaging means comprises apertures and the fixing portion comprises projections for insertion into the apertures by movement of the fixing portion in said direction.

3. A container according to claim 2 wherein the fixing portion includes tapered location projections adapted to pass into an aperture in said direction to locate the side wall relative to the base.

4. A container according to claim 2 wherein the fixing portion includes bayonet-like projections adapted to pass into an aperture in said direction, means being provided to restrain movement of said projection from the aperture in the opposite direction.

5. A container according to claim 1 wherein the folding portion is mounted for pivotal movement relative to the fixing means about an axis.

6. A container according to claim 5 wherein the axes about which the folding portions of two of the side walls are mounted are each spaced from the base a distance greater than the axes about which the folding portions of the other two side walls are mounted.

7. A container according to claim 1 wherein the folding portions are provided with engagement means to secure each side wall to two adjacent side walls.

8. A container according to claim 1 wherein the hinge of each side wall is a live hinge.

9. A container according to claim 8 wherein the foldable portion is mounted for pivotal movement relative to the fixing portion in an inward direction only, co-operable flanges being provided on the fixing portion and the folding portion respectively to locate the folding portion in a substantially upright position relative to the base, when the side wall is mounted on the base.

10. A container comprising a base comprising a receiving aperture adjacent each side thereof and side walls for mounting on said base, each side wall comprising a fixing portion having a protrusion for inserting into the respective receiving aperture of said base and a folding portion hingedly connected to the fixing portion, wherein each fixing portion is engageable with one of the engaging means by locating each side wall adjacent to one side of said base and moving the fixing portion of each side wall outwardly of said base in a direction extending at a right angle to the side of said base into snap-fitting engagement with the respective receiving aperture to provide a substantially rigid connection between the fixing portion of said side wall and said base.

11. A container according to claim 10 wherein the fixing portion of said side walls includes a tapered location projection adapted to pass into an aperture to locate said side wall relative to said base.

12. A container according to claim 10 additionally comprising means located on said side walls for securing each side wall to an adjacent side wall.

13. A container according to claim 10 wherein the folding portion of one of said side walls is mounted for pivotal movement relative to the fixing portion about an axis which is spaced from said base by a distance greater than the distance the axis of a second said side wall is spaced from said base.

14. A container according to claim 10 wherein the protrusion on the fixing portion of said side walls comprises a clip hook.

15. A container according to claim 10 wherein the protrusion on the fixing portion of said side walls comprises a rearwardly facing surface for hindering removal of the protrusion from the respective receiving aperture.

16. A method of erecting a container comprising a base with a receiving aperture and a side wall having a fixing portion with a protrusion thereon and a folding portion comprising the steps of:

(a) inserting the protrusion on the fixing portion of the side wall into the receiving aperture located along one edge of the base;

(b) moving the fixing portion of the side wall outwardly of the base in a direction extending at a right angle to the edge of the base to snap fit the protrusion into the receiving aperture; and (c) pivoting the folding portion of the side wall to an upstanding position relative to the base.

17. The method of claim 16 wherein the side wall is pivoted about an axis spaced apart from the edge of the base.

18. The method of claim 16 additionally comprising hindering removal of the protrusion from the respective receiving aperture.

19. The method of claim 16 additionally comprising repeating steps (a)–(c) with a second side wall.

20. The method of claim 19 additionally comprising securing the two side walls to each other.

* * * * *